United States Patent [19]

Balsley

[11] Patent Number: 4,602,607

[45] Date of Patent: Jul. 29, 1986

[54] INTERNAL CRANKCASE VENTILATION SYSTEM WITH EASILY ACCESSIBLE PCV VALVE

[75] Inventor: Richard L. Balsley, Washington, Mich.

[73] Assignee: General Motors Corporation, Detroit, Mich.

[21] Appl. No.: 705,145

[22] Filed: Feb. 25, 1985

[51] Int. Cl.[4] ..... F02B 25/06

[52] U.S. Cl. ..... 123/574; 123/41.86

[58] Field of Search ..... 123/572, 573, 574, 41.86

[56] References Cited

U.S. PATENT DOCUMENTS

| | | | |
|---|---|---|---|
| 2,547,587 | 9/1949 | Lowther | 123/572 |
| 3,166,061 | 1/1965 | Weiser | 123/572 |
| 3,241,534 | 3/1966 | Kennedy | 123/574 |
| 3,359,960 | 12/1967 | Pittsley | 123/574 |
| 3,381,674 | 5/1968 | Thom | 123/572 |
| 3,589,347 | 6/1971 | Sawada | 123/574 |
| 3,659,573 | 5/1972 | Bennett | 123/574 |
| 3,677,240 | 7/1972 | Sarto | 123/572 |
| 3,766,898 | 10/1973 | McMullen | 123/574 |
| 3,908,617 | 9/1975 | Partridge | 123/572 |
| 4,069,796 | 1/1978 | Balsley | 123/572 |
| 4,501,234 | 2/1985 | Toki et al. | 123/572 |
| 4,517,951 | 5/1985 | Otaka et al. | 123/572 |

*Primary Examiner*—E. Rollins Cross

*Attorney, Agent, or Firm*—Robert J. Outland

[57] ABSTRACT

An engine crankcase ventilation system has internal crankcase vapor recirculation passages including a cavity in a valve cover arranged for push-in mounting of a PCV valve in the vapor flow path and a screw cap closing the cavity through which the PCV valve is installed or removed. The screw cap preferably includes finger-like abutments to maintain the PCV valve in position against the differential pressure of crankcase vapors across the valve.

8 Claims, 2 Drawing Figures

INTERNAL CRANKCASE VENTILATION SYSTEM WITH EASILY ACCESSIBLE PCV VALVE

TECHNICAL FIELD

This invention relates to engine crankcase ventilation systems and more particularly to improved arrangements for closed crankcase ventilation systems located internally of the engine and having PCV valves mounted internally but easily accessible for servicing or replacement.

BACKGROUND

It is known in the art relating to engine crankcase ventilation systems, including closed positive crankcase ventilation systems, to provide passage defining means for conducting vapors from the engine crankcase and the connected enclosed valve actuating area of the cylinder head to the engine induction system for mixing with the intake charge and burning in the cylinders. Many such systems in use have utilized an externally mounted valve and connecting conduit as shown, for example, in U.S. Pat. No.3,359,960 Pittsley, assigned to the assignee of the present invention. In such cases, the flow control, or positive crankcase ventilation, valve, generally referred to as a PCV valve, is commonly mounted upon the exterior of an engine outer wall, such as the engine valve (or rocker) cover, and therefore, is easily accessible for servicing or replacement.

It is also known, however, to provide a closed crankcase ventilation, or vapor recycling, system in which passages communicating the crankcase with the induction system are entirely within the engine so that external piping, hoses, and so forth are avoided. One example of such an arrangement, which additionally includes internal mounting of PCV valves for controlling crankcase ventilation flow, is shown in U.S. Pat. No. 3,241,534 Kennedy, also assigned to the assignee of the present invention. In the latter arrangement, the PCV valves are mounted in openings of the cylinder head upper walls communicating with some of the inlet ports and are located within the enclosed portions covered by the rocker (or valve) covers.

The Kennedy arrangement has the advantage of providing a clean appearing engine exterior and reducing the possibility of leaks occurring in the exposed hoses and conduits of the more common externally ducted systems; however, it has the shortcoming that the PCV valves are less accessible. To service or replace the valves of the Kennedy arrangement, the valve covers must first be removed to allow access to the upper cylinder head walls upon which the PCV valves are mounted. Also, in the latter arrangement, the direct connection of the crankcase and valve cover area with individual cylinder head intake ports, does not provide the same balance of distribution of the crankcase vapors to the various cylinder intake ports which can be accomplished by systems that distribute the vapors to a central opening of the manifold feeding all of the intake ports.

SUMMARY OF THE INVENTION

The present invention provides an improved positive engine crankcase ventilation system which affords many of the advantages of various prior art systems while avoiding their disadvantages. The improved system provides completely internal passages connecting the crankcase and the valve cover area with the engine intake manifold for recycling crankcase vapors to the engine cylinders. Further, the system connection in the manifold is at a central riser on which a flow control throttle body is preferably mounted. The riser communicates with and provides induction air charges to all of the engine intake ports, thus providing balanced distribution of recycled crankcase vapors.

In addition, the improved system provides an internally disposed PCV valve which is preferably mounted in a recess of an external wall of the engine, such as in the engine rocker cover. The rocker cover is provided with an easily removable closure for the recess which allows easy access to the PCV valve for its removal for replacement or servicing.

These and other features and advantages of the improved crankcase ventilation system comprising the invention will be more fully understood from the following description of a preferred embodiment taken together with the accompanying drawing.

BRIEF DRAWING DESCRIPTION

In the drawing:

FIG. 1 is a transverse cross-sectional view of a portion of an internal combustion engine having an improved positive crankcase ventilation system formed in accordance with the invention; and FIG. 2 is a cross-sectional view through a portion of the ventilation system from the plane indicated by the line 2—2 of FIG. 1.

DETAILED DESCRIPTION

Figure 1:
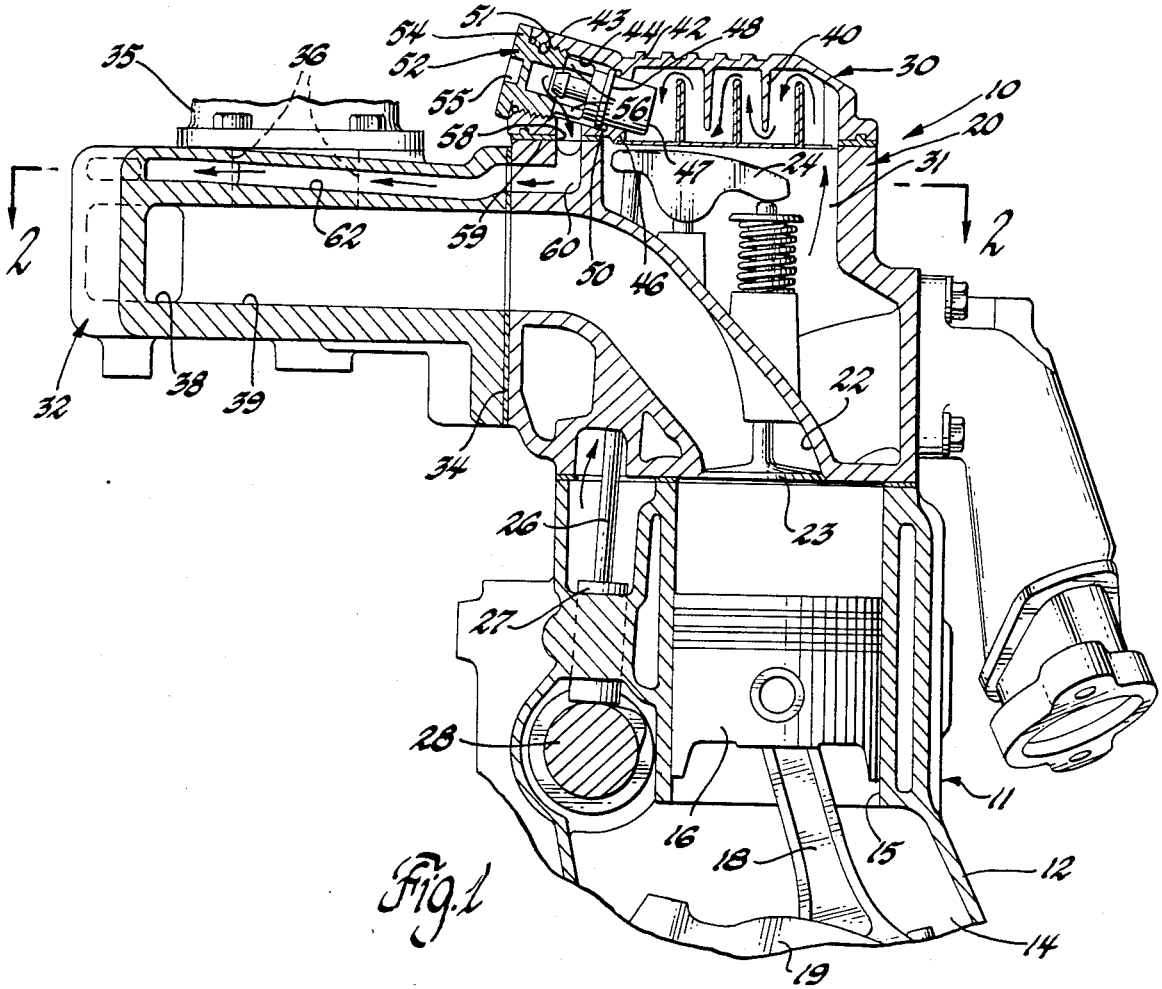
Figure 2:
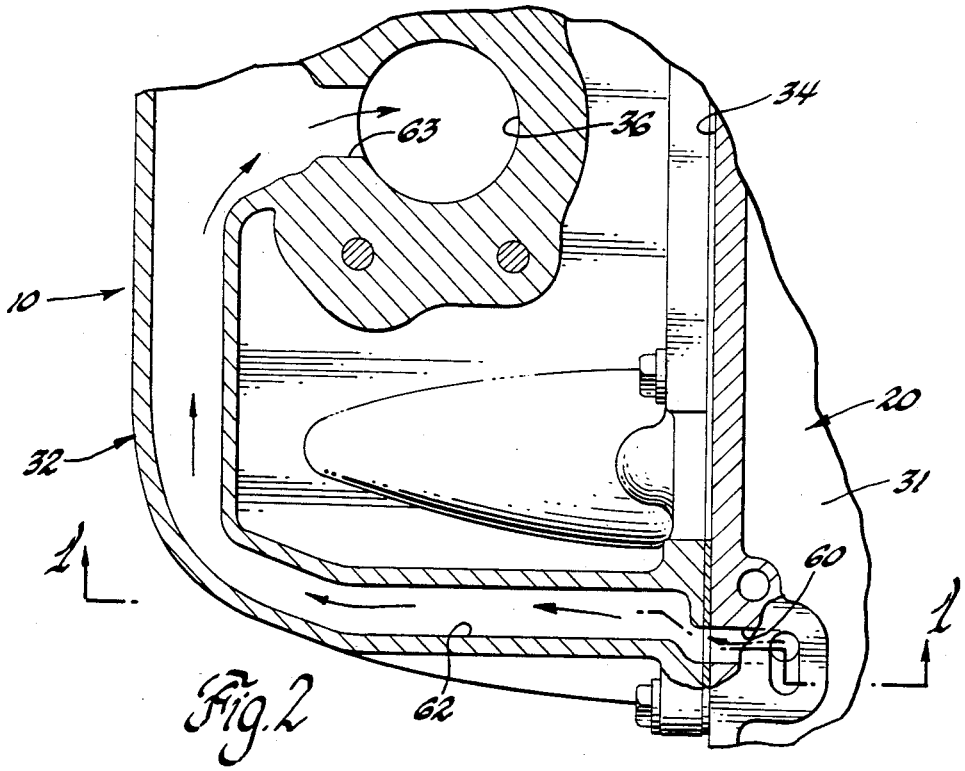

Referring now to the drawing in detail, numeral 10 generally indicates an internal combustion engine representative of such engines in general but specifically illustrative of a multi-cylinder inline spark ignition type. Engine 10 includes a cylinder block 11 which conventionally includes a lower portion 12 partially defining a crankcase 14. The cylinder block further includes a plurality of cylinders 15, only one of which is illustrated. The cylinders each have pistons 16 reciprocably disposed therein and connected by connecting rods 18 with a crankshaft 19 rotatably mounted in the crankcase in conventional manner.

As shown in the drawing, the upper ends of the cylinders 15 are closed by a cylinder head 20 which defines a plurality of inlet ports 22 and exhaust ports, not shown, each communicating with one of the various cylinders of the engine. Intake valve 23, reciprocably mounted in the cylinder head, control the passage of intake mixture from the inlet ports 22 into the respective cylinders. The valves are actuated by suitable valve gear including rocker arms 24, push rods 26 and cam followers 27 which engage a camshaft 28 operatively driven by the engine crankshaft. The rocker arms 24 are mounted on an upper portion of the cylinder head enclosed by a valve cover 30 to define a rocker chamber 31. The rocker chamber communicates with the engine crankcase 14 through openings provided for the valve actuating mechanism as well as through lubricant return or drain openings not shown.

An intake manifold 32 is mounted along a side wall 34 of the cylinder head through which open outer ends of the inlet ports 22. The manifold 32 supports a throttle body 35 and defines induction passages, including a riser passage 36 connecting with the throttle body and with a longitudinal passage 38 which in turn connects with individual intake runners 39 leading to the various inlet ports 22 of the engine.

In accordance with the invention the engine also includes an internal positive crankcase ventilation system of improved design. The improved system includes inlet baffle system 40 mounted within the valve cover 30 and defining an extended passage communicating with the rocker chamber to receive crankcase vapors therefrom. The baffle system serves to condense out oil and other liquids in the vapors passing through the baffle system and return the condensed liquids to the engine crankcase through suitable drain openings not shown.

At one side of the valve cover, its outer wall 42 is provided with a boss 43 which defines a generally cylindrical internal cavity 44. The cavity 44 has a lower flange 46 with a central opening through which the cavity communicates with the baffle system 40 within the valve cover. A positive crankcase ventilation, PCV, flow control valve 47 is received within the cavity 44. The PCV valve may be of any suitable type and, in the present instance, has an exterior configuration of the general type illustrated in U.S. Pat. No. 3,766,898 McMullen, assigned to the assignee of the present invention. The PCV valve 47 includes a hollow body 48 having an internal control element, not shown, and extending through the opening in the flange 46 to provide a controlled flow path communicating the baffle system 40 with the internal cavity 44 of the boss 43. An O-ring seal 50 engages the PCV valve body 48 and the cylindrical interior of the cavity 44 to seal the opening against the passage of crankcase vapors from the baffle system to the cavity 44 other than through the controlled interior passage of the PCV valve 47.

At its outer end, cavity 44 is provided with an internally threaded portion 51 which receives a threaded cap 52. The cap has a head 54 seatable upon the end of the boss 43 and sealingly closing the outer end of cavity 44. A socket recess 55 is preferably provided in the cap 52 for tightening the cap, although it may be designed for finger tightening if desired. On its interior, the cap includes a plurality of finger like extensions 56 which engage an enlarged portion of the valve body to positively seat the valve 47 within the opening of flange 46 while allowing crankcase ventilation vapors to flow from the outer end of the PCV valve 47 into the cavity 44.

The ventilation system further includes a lateral passage 58 connecting the cavity 44 with a valve cover lower surface 59 which seats upon the cylinder head. A cylinder head internal passage 60 connects the passage 58 through the cylinder head top wall with the side wall 34 of the cylinder head. Here passage 60 communicates with an internal passage 62 provided in the intake manifold and extending from the cylinder head side wall 34 laterally outwardly and longitudinally along the upper portion of the manifold to a lateral entry passage 63 opening into the riser passage 36 of the induction system.

In operation of the engine, blow-by gases passing the piston and mixture escaping past the valve stem seals may enter the crankcase in varying amounts and form, with the oil vapors therein, crankcase vapors which are to be recirculated to the engine induction system for burning. The crankcase vapors are drawn into the induction system by vacuum existing in the intake manifold below the throttle body, the mount of vacuum varying, depending on the operating conditions of the engine. The flow of vapors is directed from the crankcase into the rocker chamber 31 and thence into the ventilation system, passing through the baffle system 40 in the rocker cover. The crankcase vapors continues through the PCV valve 47 to the cavity 44 and thence through the passages 58, 60 and 62 of the cylinder head and manifold into the riser passage 36 of the induction system, where the vapors are mixed with the incoming air or mixture passing to the cylinders. The PCV valve is responsive to the flow and/or pressure differential in the system to control the flow of crankcase vapors recirculated in known manner.

When it is desired to replace or service the PCV valve, the threaded cap 52 is removed and the valve is exposed for removal by hand, or by means of a suitable tool, pulling on a reduced diameter end of the body 48. The serviced or replacement valve may then be installed by pushing it into the cavity with the enlarged body extending through the O-ring seal 50 and flange 46 in its seated position. Thereafter, the cap 52 is replaced with the finger-like abutments or extensions 56 engaging the body and holding the valve in its proper seated position against the differential pressure caused by vacuum applied on the downstream side of the valve.

While the described embodiment illustrates the mounting of the PCV valve in a recess in the outer wall of the engine valve cover, it should be apparent that other arrangements and locations for internally mounting the PCV valve could be selected without departing from the inventive concepts described. Thus the invention is intended to include other arrangements having the characteristics of the inventive concept which provides an internal crankcase vapor recirculation system with an internally mounted PCV valve easily accessible through a removable or openable cap or cover for servicing or replacement. Since the invention is not intended to be limited to the described embodiment, but to include modifications thereof within the spirit of the invention, it is intended that the invention be limited by only the language of the following claims.

I claim:

1. A crankcase ventilation system having a flow limiting PCV valve and means defining and internal passage between a crankcase and a cylinder charge induction means of an engine, said system comprising an engine valve cover forming a part of said internal passage defining means and having an exterior wall, a cavity in said cover wall and forming a portion of said internal passage, said wall further including valve mounting means surrounding said passage and receiving said valve and a valve body seal in position to control flow through said mounting means and passage and an opening through said wall to the housing exterior and generally opposite said mounting means for removing and replacing a valve on said mounting means, and closure means normally closing said opening and preventing air leakage therethrough into the induction system, said closure means engaging the valve to maintain its installed position within the wall cavity and being openable to permit removal of said PCV valve.

2. A system in accordance with claim 1 wherein said closure means comprises a screw cap threadably engagable with said engine housing, said cap including finger like extensions engagable with the valve to retain the valve in the opening when the cap is installed.

3. A combination comprising an engine valve cover having internal passage defining means adapted to form a part of an engine crankcase ventilation system, said cover including an external wall having exterior and interior sides, a mounting surface, and means defining a cavity with a first opening through the exterior side of the wall, a second opening through the interior side and a third outlet opening through said mounting surface, a PCV valve with a resilient seal retained in said second opening, said valve extending into the cavity to control fluid flow through the cavity from the interior side of the wall to the mounting surface and being removable from the second opening through said first opening, and closure means normally engaging the valve to retain it in position and closing said first opening to prevent air leakage therethrough, said closure means being openable to permit access to and removal of said valve.

4. A combination according to claim 3 wherein said engine valve cover is mountable upon a surface of a cylinder head having an internal crankcase vapor recirculation passage connecting with said third outlet opening when the valve cover is so mounted.

5. An engine valve cover having a wall with interior and exterior sides and means defining a cavity between said sides and opening to both through opposed inner and outer openings, respectively for push-in mounting of a PCV valve in said inner opening through said outer opening, and closure means cooperating with the cavity defining means to normally close said outer opening and openable for removal of said PCV valve for servicing or replacement, said closure means including abutments engageable with said PCV valve when the closure means is in position closing said outer opening to thereby hold the PCV valve in said inner opening.

6. A valve cover as in claim 5 wherein said closure means is a screw cap.

7. An engine having a completely internal crankcase ventilation system comprising housing means defining a crankcase, a plurality of cylinders, valve controlled inlet ports communicating with the cylinders and a valve chamber communicating with the crankcase, an intake manifold mounted on the housing means and having internal charge distribution passages communicating with the housing inlet ports, a valve cover mounted on the housing means and having an exterior wall closing one side of said chamber, said wall having exterior and interior sides, a mounting surface seated on the housing means and means defining a cavity, the cavity having a first opening to the engine exterior through the exterior side of the wall, a second opening to the valve chamber through the interior side of the wall and a third outlet opening to the housing means through the mounting surface, a crankcase vapor recirculation passage connecting with the valve cover third outlet opening and extending internally through the housing means into the intake manifold, communicating therein with the charge distribution passages, a PCV valve having a body with a surrounding resilient seal for push-in mounting retained in the valve cover second opening and extending into the cavity to control vapor flow from the valve chamber through the cavity to the manifold recirculation passage, said valve being removable from the second opening through the first opening, and closure means engaging the valve to retain it in position and closing the first opening to prevent air leakage therethrough into the vapor recirculation passage, said closure means being openable to permit access to and replacement of the valve.

8. An engine as in claim 7 wherein the closure means is a screw cap having finger like extensions to retainingly engage the valve when installed and the valve cover includes an oil separating baffle system within the valve chamber and into which the valve extends to conduct relatively oil-free vapors into the recirculation passage for delivery to the cylinders.

* * * * *